US010905632B1

(12) United States Patent
Gonzalez

(10) Patent No.: US 10,905,632 B1
(45) Date of Patent: Feb. 2, 2021

(54) DOSAGE MANAGEMENT DEVICE

(71) Applicant: Jose Gonzalez, San Antonio, TX (US)

(72) Inventor: Jose Gonzalez, San Antonio, TX (US)

( * ) Notice: Subject to any disclaimer, the term of this patent is extended or adjusted under 35 U.S.C. 154(b) by 0 days.

(21) Appl. No.: 16/448,192

(22) Filed: Jun. 21, 2019

(51) Int. Cl.
*A61J 7/04* (2006.01)
*A61J 1/03* (2006.01)

(52) U.S. Cl.
CPC ..... *A61J 7/0481* (2013.01); *A61J 1/03* (2013.01); *A61J 7/0427* (2015.05)

(58) Field of Classification Search
USPC ..... 206/534; 215/230, 365
See application file for complete search history.

(56) References Cited

U.S. PATENT DOCUMENTS 3,151,599 A * 10/1964 Livingston ..... A61J 7/04 116/308
4,203,518 A * 5/1980 Current ..... B65D 83/02 206/380
4,572,376 A * 2/1986 Wrennall ..... A61J 7/04 206/534
4,756,423 A * 7/1988 Holtsch ..... A61J 7/04 116/308
5,011,032 A * 4/1991 Rollman ..... A61J 7/04 116/321
5,299,701 A * 4/1994 Barker ..... A61J 7/04 215/216
5,577,335 A * 11/1996 Tucker ..... A47B 23/044 116/309
5,803,283 A * 9/1998 Barker ..... A61J 7/02 116/308
5,984,122 A * 11/1999 Barker ..... A61J 7/02 116/308
6,227,371 B1 5/2001 Song
6,545,592 B2 4/2003 Weiner
6,938,757 B2 * 9/2005 Eastman ..... B65D 55/026 206/219
7,000,791 B2 * 2/2006 Miller ..... A61J 7/04 206/534
7,222,736 B1 * 5/2007 Seijas ..... A61J 7/04 116/308
7,240,795 B2 * 7/2007 Lee ..... B65D 25/04 206/457

(Continued)

*Primary Examiner* — Jacob K Ackun
(74) *Attorney, Agent, or Firm* — Sanchelima & Associates, P.A.; Christian Sanchelima; Jesus Sanchelima

(57) ABSTRACT

The present invention discloses a dosage management device comprising a lid with dosage regimen indicia. The dosage regimen indicia comprise information related to dosage frequency. The dosage regimen indicia are a representation of AM, PM, day and night. The lid comprises a first layer having a cavity, a second layer disposed within the cavity comprising dosage regimen indicia on an upper surface thereof and a third layer having an opening, encloses the cavity of the first layer. The first layer, the second layer and the third layer are connected to one another via a swivel mount. The swivel mount is configured to enable the user to rotate the third layer 45 degrees to shade at least a portion of the dosage regimen indicia comprising the information related to the frequency at which the medication is to be retrieved from the container and expose at least a portion of the dosage regimen indicia comprising the information related to a subsequent frequency.

10 Claims, 3 Drawing Sheets

(56) References Cited

U.S. PATENT DOCUMENTS

| | | | | |
|---|---|---|---|---|
| 8,328,031 | B2 * | 12/2012 | Gonzalez Sanchez | B65D 55/145 206/534 |
| 2014/0202978 | A1 * | 7/2014 | Hwang, II | A61J 7/04 215/230 |

* cited by examiner

DOSAGE MANAGEMENT DEVICE

BACKGROUND OF THE INVENTION

1. Field of the Invention

The present disclosure relates to a dosage management device. More particularly, the present disclosure relates to a dosage management device comprising a lid with dosage regimen indicia.

2. Description of the Related Art

Problems related to multiple dosing or nil dosing are well known in medical care art. There are many medical conditions which critically rely upon the careful administration of drugs such as in the areas of anti-coagulation, seizures, diabetes, narcotics, antibiotics and cardiac medications. Missed medicine doses contribute to both drug tolerance in the body and drug resistance of pathogens, neither of which is in the best interest of patients. Another very common problem is that people take medicine doses at improper time intervals. People impaired by illness, medication, or simple memory loss may overdose. These very common problems have negative effects on patient health. In fact, people die every year from improperly administered medication. It is therefore highly desirable to provide a tool that help them to take their medicines in the manner prescribed.

Several devices have been designed in the past. None of them, however, include a dosage management device that is capable of addressing the foregoing discussed issues.

Applicant believes that a related reference corresponds to U.S. Pat. No. 6,545,592 filed by Steven L. Weiner describes a medication reminder device. Steven reference discloses a medication reminder device having a cap unit with a timer dial for selecting a period between alarm signals, and a start and reset button with a light. The cap unit having internal electronics with a power supply to generate an alarm signal that is preferably visible, using the button light, a sound generating circuit, and a vibrator mechanism. The cap unit is connected to a compact container with a compartment for storage of pills. The compact container having an adaptor cap for connecting the assembled device to a standard prescription container. However, Steven reference discloses a complex construction, and would not be preferred by people such as elderly who are not accustomed to electronic devices.

Another related reference is U.S. Pat. No. 6,227,371 filed by Julie Song describes a medical container and system. Julie reference discloses a system of containers having tactile identification indicia means on the cover of the container. The originally dispensed medication is placed inside a larger container from which the medication is dispensed to the patient. The larger container having tactile indicia identifying the medication therein. The tactile indicia include at least the first letter of the name of the medication. In addition to the letters of the name of the medication, the indicia may also include Braille symbols for the letters, as well as unique indicia for indicating the prescribed dosage. The system may also include a separate printed chart listing the indicia for each medication for use by sighted caregivers. However, Julie reference lacks to address multiple dosing, particularly, people impaired by illness, medication, or simple memory loss.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a dosage management device comprising a lid with dosage regimen indicia.

It is another object of the present invention to provide a dosage management device with a unique, clearly visible, human readable and representation of dosing schedule.

It is yet another object of the present invention to provide a dosage management device that is inexpensive, simple, convenient and easy to use.

It is yet another object of the present invention to provide a dosage management device comprising a lid impressed or printed with the dosage information in the form of words, abbreviations and/or pictorial representations.

It is yet another object of the present invention to provide a lid attachable to a container comprising a dosage regimen indicium on an upper surface thereof, wherein the indicia comprises information related to dosage frequency.

It is yet another object of the present invention to provide a lid comprising a first layer having a cavity, a second layer disposed within the cavity comprising dosage regimen indicia impressed on an upper surface and a third layer encloses the cavity comprising an opening, wherein each layer is connected together via a swivel mount, and wherein the swivel mount is configured to enable the user to rotate the third layer 45 degrees to shade at least a portion of indicia comprising the information related to the frequency at which the medication is to be retrieved from the container and expose at least a portion of the indicia comprising the information related to a subsequent frequency.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
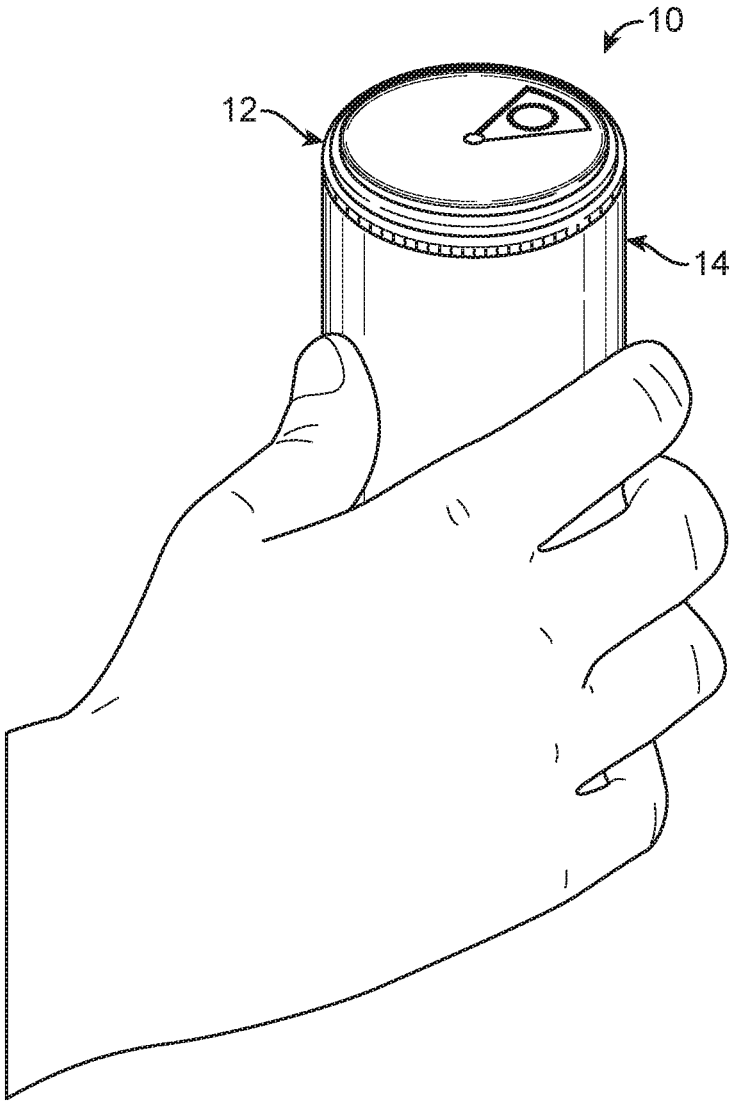
FIG. 1 exemplarily illustrates a perspective view of a user utilizing a dosage management device 10 in an embodiment of the present invention. The dosage management device 10 comprising a container 14 and a lid 12 with dosage regimen indicia is illustrated.
Figure 2:
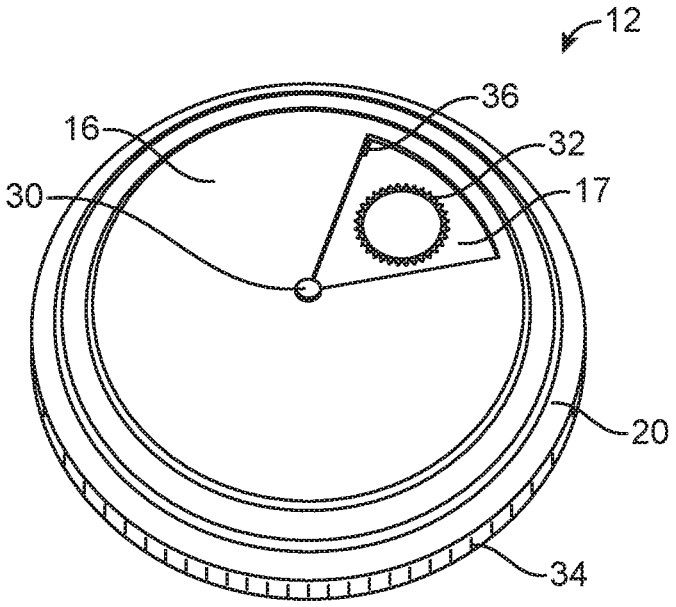
FIG. 2 exemplarily illustrates a perspective view of the lid 12 in an embodiment of the present invention. The lid 10 comprising dosage regimen indicia 32 is illustrated.
Figure 3:
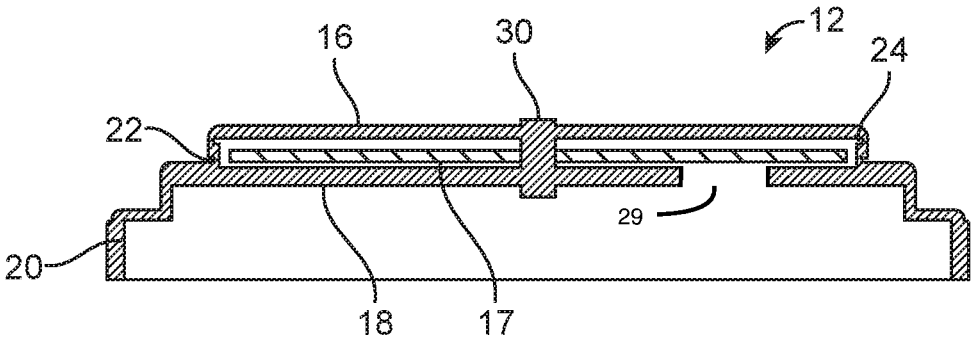
FIG. 3 exemplarily illustrates a cross sectional view of the lid 12 in an embodiment of the present invention. The lid 12 comprising a first layer 18, a second layer 17 and a third layer 16 connected together via a swivel mount 30 is illustrated.
Figure 4:
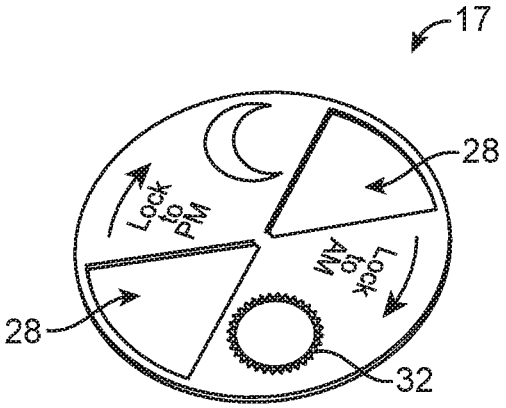
FIG. 4 exemplarily illustrates a perspective view of the second layer 17 in an embodiment of the present invention. The second layer 17 comprising at two apertures 28 and dosage regimen indicia 32 is illustrated.
Figure 5:
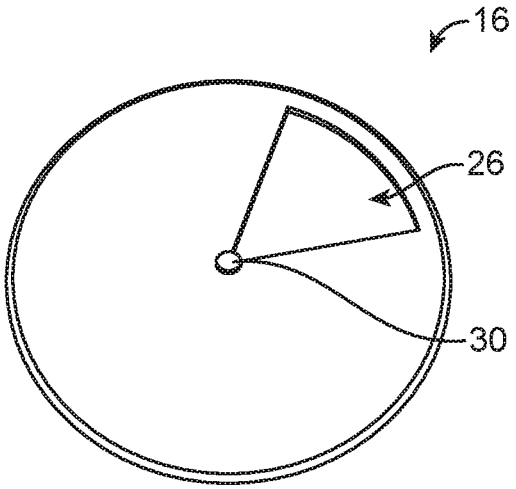
FIG. 5 exemplarily illustrates a perspective view of the third layer 16 in another embodiment of the present invention. The third layer 16 comprising an opening 26 is illustrated.

Referring now to the drawings, FIGS. 1-5, where the present invention is generally referred with numeral 10, it can be observed that a dosage management device 10 comprising a lid 12 with dosage regimen indicia 32 to help a patient or a user to take a prescribed dosage of medication at a prescribed time, is disclosed. The lid 12 helps patients to maintain a regular day and night dosing schedule.

In one embodiment, the lid 12 is adapted to detachably attach to a container 14. The lid 12 comprises dosage regimen indicia 32 on an upper surface thereof. The dosage regimen indicia 32 comprise information related to dosage frequency. In one embodiment, the dosage regimen indicia 32 are a representation of AM, PM, day and night. In another embodiment, the dosage regimen indicia are a pictorial representation of AM, PM, day and night. In an embodiment, words representing day and night could be imprinted in at least one language including, but not limited to, English, Spanish, Braille. In one embodiment, the dosage regimen indicia 32 comprise a pictorial representation of the sun and moon indicating AM, PM, day and night. In addition, languages used to represent AM, PM, day and night could also be stamped to the lid.

The lid 12 comprises at least two layers connected to each other through a rotation mechanism such as swivel mechanism. The rotation mechanism is configured to rotate the lid 12 forty-five degrees (45°) to provide access to the medication in the container. The rotation mechanism is configured to rotate another forty-five degrees, totaling 90 degrees, to secure the lid 12 to the container. This 90-degree rotation is configured to provide access to retrieve medication and shades at least a portion of dosage regimen indicia 32, comprising the information related to the frequency at when the medication retrieved from the container.

In one embodiment, the lid 12 comprises at least three layers connected to one another. The at least three layers comprise a first layer, a second layer and a third layer. An edge 22 of the first layer 18 extends upwards to form a cavity 24. The second layer 17 is disposed within the cavity 24 of the first layer 18 comprising dosage regimen indicia 32 on an upper surface thereof, wherein the dosage regimen indicia 32 comprise information related to the dosage frequency. The third layer 16 encloses the cavity 24 of the first layer 18 comprising an opening 26. The first layer 18, the second layer and the third layer are parallel to one another. The first layer 18, the second layer 17 and the third layer 16 are connected to one another via the swivel mechanism. The swivel mechanism comprises a swivel mount 30.

The swivel mount 30 is configured to enable the user to rotate the third layer 16 45 degrees to shade at least a portion of dosage regimen indicia 32 comprising the information related to the frequency at when the medication retrieved from the container and expose at least a portion of dosage regimen indicia 32 comprising the information related to a subsequent frequency. Therefore, as the user consume each dose, they could twist lid 12 to indicate the next available dose and be reminded to take that dosage at the appropriate time.

In one embodiment, the second layer 17 comprises at least two apertures 28 to dispense medication. In another embodiment, the first layer 18 also comprises a passage 29 observed in FIG. 3. The passage 29, aperture 28 and opening 26 of the first layer 18, second layer 17 and third layer align to dispense the medication within the container 14. Further, the edge 22 of the first layer 18 extends downward to form a wall 20 configured to fasten with a rim of the container 14. The lid 12 further comprises a locking member 36 at every forty-five degree (45°) turn of the lid 12. The locking member 36 is configured to lock the lid 12, at every 45° turn. In another embodiment, the lid 12 comprises grip grooves 34 along the exterior side of the wall 20 for ease of opening.

In one embodiment, the dosage regimen indicia 32 represents a dosage of the medication (e.g., a quantity of pills, a quantity of fluid, etc.). In one embodiment, the lid 12 is made of plastic material, which is inexpensive to produce or purchase. In another embodiment, the lid 12 is made of a material selected from the group consisting of polycarbonate, polyethylene, polyethylene terephthalate, polypropylene, polystyrene, polyvinyl chloride and mixtures thereof. In one embodiment, the lid 12 is configured to glow in the dark. In one embodiment, the lid 12 is circular in shape. In one embodiment, the lid 12 can be ½" in height, 2" in length and 2" in width. In one embodiment, the shape, dimensions and material of the lid 12 may vary according to the needs of the end user. In one embodiment, the dosage management device 10 comprises one or more lids 12 in varying sizes. In another embodiment, the dosage management device 10 comprises one or more lids 12 in same sizes. In one embodiment, the lid 12 could be affixed to existing pill containers.

In one embodiment, the dosage management device 10 or product is sterilized prior to packaging in a polyvinylchloride plastic pouch, heat sealed to protect the contents. A quantity of the individually packaged products could then be placed in corrugated cardboard self-shipping cartons to facilitate shipment and storage. A self-adhesive label could be affixed to each carton to identify the product.

Advantageously, the lid 12 impressed or printed with dosage information in the form of words, abbreviations and/or pictorial representations. The present invention enables the user or patient to take medication at the proper time of day. Further, the functionality of moving the lid 12 to a different position after each dose to shade/represent the consumed frequency, enables the user to efficiently and conveniently follow doctor's or medical practitioner's instructions. Further, the pictorial representation enables any user to understand the dosage information without language barrier.

The present invention could be useful to pharmaceutical companies, nursing centers, or people who want to take medication at the proper time of the day. In addition, the lid 12 could be incorporated with Braille language to help visually impaired people. The dosage management device 10 would be especially appealing to elderly individuals, as these individuals often struggle to remember which medications to take at specific intervals of the day. The present invention further comprises simple and convenient means to clearly indicate when the next scheduled dose is due to dispense. Further, taking medication in the right amount at the right time would ensure that a proper amount of medication was in the system. This would help patients to receive the maximum benefit. Patients could avoid making medication errors, such as taking a drug too soon or missing a dose. Further, the usage of symbols and Braille language helps a handicapped person or vision impaired person to utilize the device 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A medicine container, comprising:

a lid attachable to a container having at least three layers including a first layer, a second layer, and a third layer, wherein an edge of said first layer extends upward to form a cavity, wherein said second layer is nested within said cavity of said first layer, said second layer comprising dosage regimen indicia, wherein said second layer is a circular disk having at least two apertures, wherein said at least two apertures extend towards a center of said second layer, wherein said dosage regimen indicia is located on a top end of said second layer between said at least two openings, said dosage regimen indicia comprises information related to dosage frequency, and wherein said third layer encloses said cavity of said first layer, wherein said third layer includes at least one opening which extends towards a center of said third layer, and wherein said first layer comprises an passage.

2. The medicine container of claim 1, wherein said first layer, said second layer and said third layer are parallel to one another.

3. The medicine container of claim 1, wherein said edge of said first layer extends downward to form a wall configured to fasten with said container.

4. The medicine container of claim 1, wherein said dosage regimen indicia are a representation of AM, PM, day and night.

5. The medicine container of claim 1, wherein said dosage regimen indicia are a representation of AM, PM, day and night in Braille language.

6. The medicine container of claim 1, wherein said dosage regimen indicia are a pictorial representation of AM, PM, day and night.

7. The medicine container of claim 1, wherein said at least one opening of said third layer includes a locking member protruding from an inner edge.

8. The medicine container of claim 3 wherein said wall includes grip grooves on an exterior portion.

9. The medicine container of claim 1 wherein said lid is a glow in the dark lid.

10. A medicine container, consisting of:

a) a pill container having a cylindrical shape; and b) a lid mounted to a top end of said pill container, said cap consisting of:

i. a first layer having a top end and a bottom end, wherein said first layer further includes an edge, wherein said edge extends upwardly from said top end to form a cavity, wherein said edge further extends downwardly from said bottom end of said first layer to form a wall adapted to fasten with a rim of said pill container, said wall further including grip grooves along an exterior side, said first layer further including a passage;

ii. a second layer nested entirely within said cavity, wherein said second layer is a circular disk layered over said top end of said first layer, wherein said second layer includes two apertures each having a triangular shape, wherein said two apertures extend towards a center of said second layer, said second layer further including dosage regimen indicia on a top end; and iii. a third layer located above said first layer and said second layered, wherein said third layer entirely encloses said second layer within said first layer, wherein said third layer is a circular disk having a single opening, wherein said singular opening is triangular in shape and extends towards a center of said third layer, said third layer further including a locking member protruding from an inner edge of said single opening.

* * * * *